US011529821B2

(12) United States Patent
Kambara et al.

(10) Patent No.: US 11,529,821 B2
(45) Date of Patent: Dec. 20, 2022

(54) BOOK BLOCK FEED DEVICE

(71) Applicant: Horizon International Inc., Takashima (JP)

(72) Inventors: Kanta Kambara, Takashima (JP); Shigenobu Fukuda, Takashima (JP); Kohei Okamoto, Takashima (JP); Hiroto Otani, Takashima (JP); Takehito Yokogi, Takashima (JP); Shigeru Wakimoto, Takashima (JP)

(73) Assignee: Horizon International, Inc., Takashima (JP)

( * ) Notice: Subject to any disclaimer, the term of this patent is extended or adjusted under 35 U.S.C. 154(b) by 0 days.

(21) Appl. No.: 17/090,563

(22) Filed: Nov. 5, 2020

(65) Prior Publication Data

US 2021/0138822 A1 May 13, 2021

(30) Foreign Application Priority Data

Nov. 7, 2019 (JP) ..... JP2019-202138

(51) Int. Cl.
*B42C 19/00* (2006.01)
*B42C 19/08* (2006.01)
*B42C 13/00* (2006.01)

(52) U.S. Cl.
CPC ..... *B42C 13/00* (2013.01); *B42C 19/00* (2013.01); *B42C 19/08* (2013.01)

(58) Field of Classification Search
CPC ..... B42C 19/00; B42C 19/08
See application file for complete search history.

(56) References Cited

U.S. PATENT DOCUMENTS 4,227,275 A * 10/1980 Soderberg ..... B65H 31/34 227/100
6,966,553 B2 * 11/2005 Rathert ..... B42C 19/08 412/9
8,915,349 B2 * 12/2014 Tas ..... B42C 19/08 198/408

(Continued)

FOREIGN PATENT DOCUMENTS

DE 3840816 A1 * 6/1990 ..... B42C 19/08
EP 1970330 A1 * 9/2008 ..... B42C 19/08

(Continued)

OTHER PUBLICATIONS

EP-1970330-A1 English Translation (Year: 2008).*

(Continued)

*Primary Examiner* — Kyle R Grabowski
(74) *Attorney, Agent, or Firm* — Muncy, Geissler, Olds & Lowe, P.C.

(57) ABSTRACT

Provided is a book block feed device capable of feeding a book block always in an aligned state to a bookbinding machine. The book block feed device comprises an alignment unit and a press unit that are adjacently arranged in order along a conveying path of the book block from an inlet to an outlet of the conveying path. The alignment unit comprises a vibrator that vibrates the book block. The press unit includes a press surface that forms a part of a conveying surface of the conveying path, and a press plate that sandwiches and presses the book block between the press plate and the press surface.

6 Claims, 12 Drawing Sheets

(56) References Cited

U.S. PATENT DOCUMENTS

| | | | | |
|---|---|---|---|---|
| 2002/0061238 | A1* | 5/2002 | Marsh | B42C 19/02 412/9 |
| 2006/0076725 | A1* | 4/2006 | Matalevich | B42C 19/08 270/58.08 |
| 2014/0360839 | A1* | 12/2014 | Moesli | B42C 19/08 198/370.07 |

FOREIGN PATENT DOCUMENTS

| | | | | |
|---|---|---|---|---|
| GB | 2249524 | A * | 5/1992 | B42C 19/08 |
| JP | H 07-89258 | A | 4/1995 | |
| JP | 2010-274501 | A | 12/2010 | |
| JP | 2018-199222 | A | 12/2018 | |
| KR | 101685621 | B1 * | 12/2016 | |

OTHER PUBLICATIONS

KR-101685621-B1 Enlgish Translation (Year: 2016).*
Extended European Search Report for European Application No. 20205465.6, pp. 1-6, dated Mar. 15, 2021.

* cited by examiner

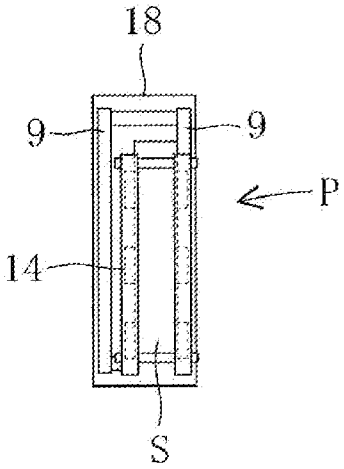
FIG. 6A
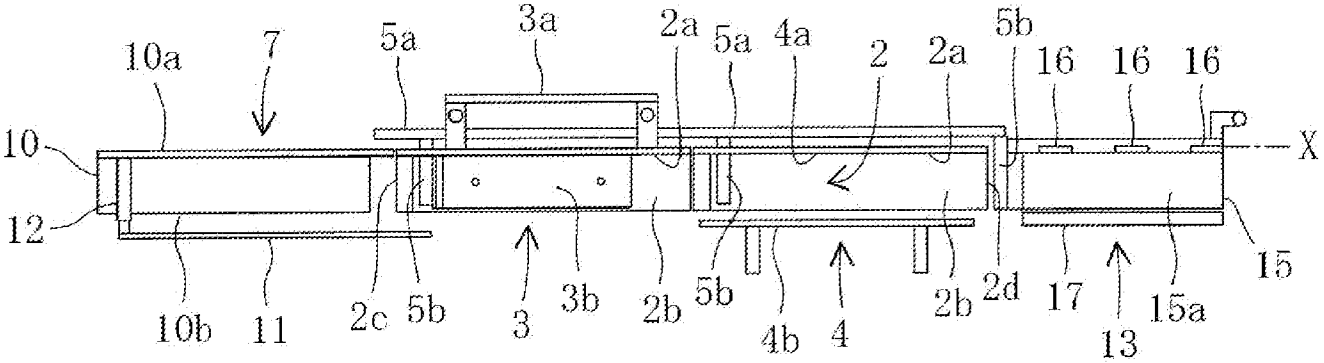

BOOK BLOCK FEED DEVICE

CROSS-REFERENCE TO RELATED APPLICATION

This application is based on Japanese Patent Application No. 2019-202138, filed on Nov. 7, 2019, the contents of which are incorporated herein by reference in its entirety.

TECHNICAL FIELD

The present disclosure relates to a book block feed device that feeds, to a bookbinding apparatus, a book block that is not temporarily bound.

BACKGROUND

A bookbinding process may include accumulating sheets of paper to form a book block, aligning the book block, and then performing processing such as bookbinding and cutting.

For example, in perfect binding, sheets of paper sequentially discharged from a printer or a copier are accumulated by an accumulating device or the like, to form a book block, and the book block in an aligned state is fed to a clamper for a bookbinding machine. Then, the book block held with the clamper is conveyed between respective bookbinding processing units of the bookbinding machine by the clamper, and is bound as a book during the conveyance (e.g., see Japanese Unexamined Patent Application, Publication No. 2010-274501).

In this case, a book block feed device is used to feed the book block to the clamper for the bookbinding machine.

This type of book block feed device is described, for example, in Japanese Unexamined Patent Application, Publication No. 2018-199222.

The book block feed device described in Japanese Unexamined Patent Application, Publication No. 2018-199222 is disposed between a printer and a bookbinding machine, and a book block comprising sheets of paper discharged from the printer is fed in an aligned state to a clamper for the bookbinding machine.

This book block conveying device includes a support stand, an articulated robot provided on the support stand, and a storage aligning section provided on the support stand, to store and align the book block.

The articulated robot includes a rotating section attached to the support stand, and a hand unit supported by the rotating section via an articulated arm, to hold the book block.

The storage aligning section includes a storage box that stores the book block, a vibrating section that vibrates the storage box, and a rotary shaft coupled to the support stand to rotatably support the vibrating section. The rotary shaft tilts the storage box integrally with the vibrating section.

According to this book block conveying device, if a predetermined number of sheets of paper are printed in the printer to form the book block, the articulated robot holds the book block with the hand unit, and stores the book block in the storage box of the storage aligning section.

Next, the rotary shaft of the storage aligning section tilts by a predetermined angle, and then the storage box is vibrated by the vibrating section, to perform alignment processing. After end of the alignment processing, the rotary shaft rotates in reverse, and the storage box returns to its original position.

Afterward, the book block in the aligned state is held with the hand unit of the articulated robot, removed from the storage box, and fed to the clamper for the bookbinding machine.

However, in this book block feed device, the book block aligned by the storage aligning section contains air among the sheets of paper, and easily causes misalignment among the sheets of paper. Therefore, when the aligned book block is transferred from the hand unit to the clamper, the alignment of the book block might be disordered.

Then, if the book block in a non-aligned state is fed to the clamper, finish of bookbinding might be deteriorated, or defective products might be generated.

To solve this problem, the clamper comprises a mechanism of butting and aligning the book block, and hence when the clamper receives feed of the book block from the book block feed device, the alignment disorder of the book block is corrected on a clamper side.

That is, in a case where the book block feed device does not comprise a mechanism of correcting disturbance in the book block when the clamper for the bookbinding machine receives the feed of the book block, there is concern that the book block in the non-aligned state is fed to the clamper.

Therefore, this book block feed device has a disadvantage that the device cannot be used in the clamper that is not provided with the mechanism of correcting the disturbance in the book block when receiving the feed of the book block.

SUMMARY

Therefore, an object of the present disclosure is to provide a book block feed device capable of feeding a book block always in an aligned state to a bookbinding machine.

To solve the above-mentioned problems, the present disclosure employs the following solutions.

A book block feed device that feeds a book block to a bookbinding machine according to one aspect of the present disclosure includes: an alignment unit and a press unit that are adjacently arranged in order along a conveying path of the book block from an inlet to an outlet of the conveying path, the alignment unit including at least one vibrator that vibrates the book block, the press unit including a press surface that forms a part of a conveying surface of the conveying path, and a press plate that sandwiches and presses the book block between the press plate and the press surface.

The book block feed device according to one aspect of the present disclosure may include: a frame including the conveying path, wherein the conveying path including a first conveying surface to support one surface of the book block, and a second conveying surface extending from a lower edge of the first conveying surface, and to support one side surface of the book block, the alignment unit and the press unit are provided in the frame, the conveying path including a part in a region of the alignment unit and a part in a region of the press unit, the parts being independent of each other, the at least one vibrator is coupled to the first conveying surface and/or the second conveying surface of the conveying path, the press surface forms a part of the first conveying surface of the conveying path, and the press plate is disposed to face the press surface, and movable in a direction close to and away from the press surface, the press unit including: a press plate drive mechanism that moves the press plate in a direction vertical to the press surface between a standby position away from the book block disposed on the press surface and a pressing position to press the book block toward the press surface, the book block feed device further comprising: a conveying mechanism that conveys the book block along the conveying path, a paper feed unit provided in the frame and disposed in the inlet of the conveying path, to receive feed of the book block and to send the received book block to the alignment unit, and a transfer mechanism provided in the frame and disposed in the outlet of the conveying path, to feed the book block pressed by the press unit to the bookbinding machine, wherein the book block sent from the paper feed unit is conveyed between the alignment unit and the press unit by the conveying mechanism, and subjected to a processing operation to the book block by each of the alignment unit and the press unit.

In the book block feed device according to one aspect of the present disclosure, at least one air outlet which is opened in the second conveying surface of the conveying path in the alignment unit, and the alignment unit further includes a blower connected to the at least one air outlet.

In the book block feed device according to one aspect of the present disclosure, the transfer mechanism includes: a receiving unit attached to the frame, to receive the book block discharged from the press unit and to support the book block in a vertically standing state, a hand unit that is to hold the book block supported by the receiving unit, and a hand moving mechanism attached to the frame, to move the hand unit between the receiving unit and the bookbinding machine.

In the book block feed device according to one aspect of the present disclosure, the paper feed unit, the alignment unit and the press unit are arranged on a straight line, and the receiving unit includes: a carriage having a flat upper surface that supports the one side surface of the book block, a fixing plate attached to the carriage and extending vertically to the upper surface, to support the one surface of the book block, a movable plate that is disposed to face the fixing plate and movable in a direction close to and away from the fixing plate, a plate drive mechanism attached to the carriage, to move the movable plate in a direction vertical to the fixing plate between a holding position to hold the book block between the movable plate and the fixing plate and a hold releasing position that is away from the book block on the fixing plate, and a carriage drive mechanism attached to the frame, to turn the carriage about a vertical axis between an aligned position where the upper surface and the fixing plate are arranged on a straight line with the conveying path and a turned position rotated by 90° from the aligned position, and to rotate the carriage about an axis parallel to a line of intersection of the upper surface with the fixing plate between a standing position where the upper surface is disposed horizontally and the fixing plate is disposed vertically and a tilt position where the upper surface matches the second conveying surface and the fixing plate matches the first conveying surface at the aligned position.

According to the present disclosure, a book block aligned by an alignment unit is pressed by a press unit, and air in the book block is removed. Afterward, the book block is fed to a bookbinding machine (a clamper) by a transfer mechanism.

Thus, air is removed, and hence an aligned state of the book block does not easily collapse. Therefore, when the book block is transferred to the bookbinding machine (the clamper) by the transfer mechanism, alignment of the book block can be reliably prevented from being disordered.

Consequently, the book block can be fed always in the aligned state even to the bookbinding machine (the clamper) that does not include a mechanism of correcting the disorder of the alignment of the book block.

Furthermore, according to the present disclosure, an alignment unit and a press unit are adjacently arranged, and a book block is intermittently conveyed for each unit between the alignment unit and the press unit, and subjected to a processing operation to the book block by each of the alignment unit and the press unit, so that alignment of the book block and the subsequent air removal can be performed at high speed.

BRIEF DESCRIPTION OF THE DRAWINGS

FIG. 6A shows a plan view of the schematic configuration of the book block feed device according to the example of the present disclosure.

DESCRIPTION OF THE EMBODIMENTS

Hereinafter, a configuration of the present disclosure will be described based on a preferable example, with reference to the accompanying drawings.

Figure 1A:
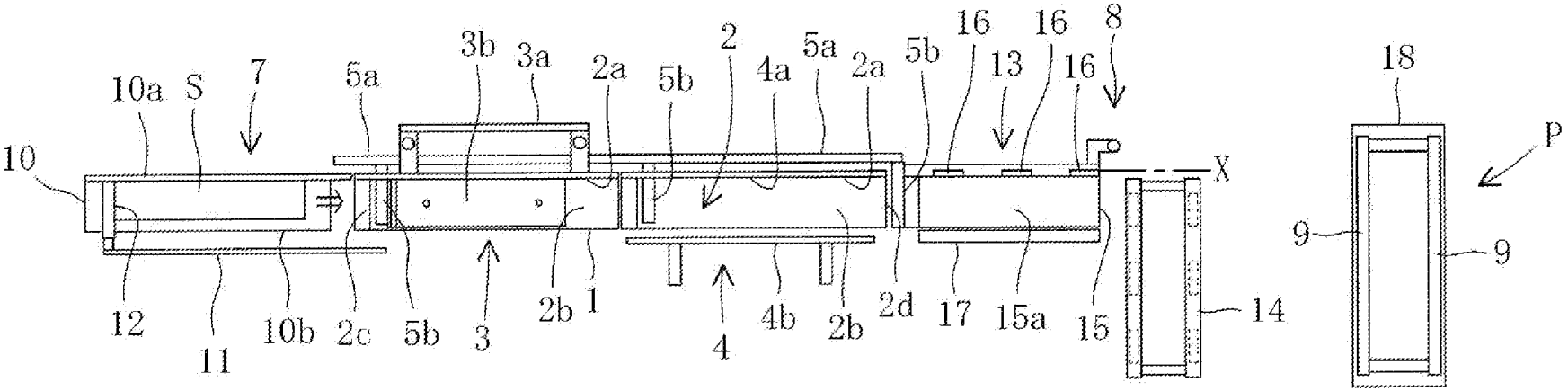
FIG. 1A shows a plan view of a schematic configuration of a book block feed device according to an example of the present disclosure.
Figure 1B:
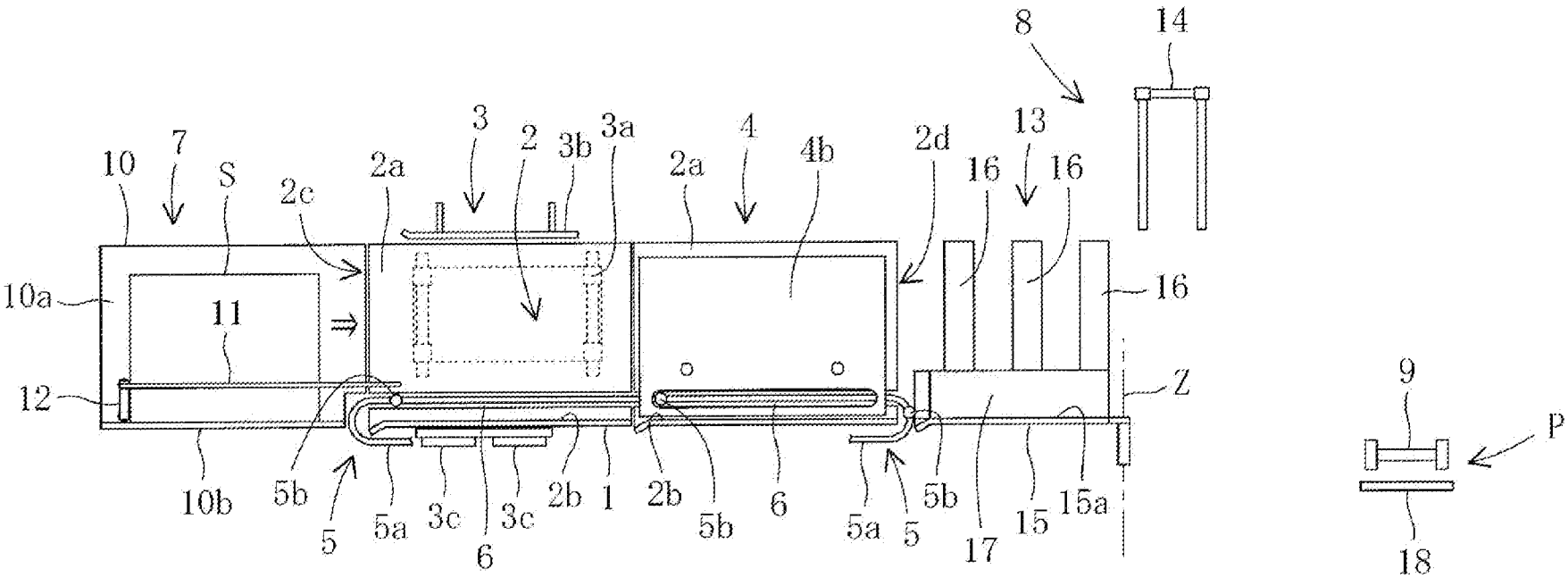
FIG. 1B shows a front view of a schematic configuration of a book block feed device according to an example of the present disclosure.
Figure 2A:
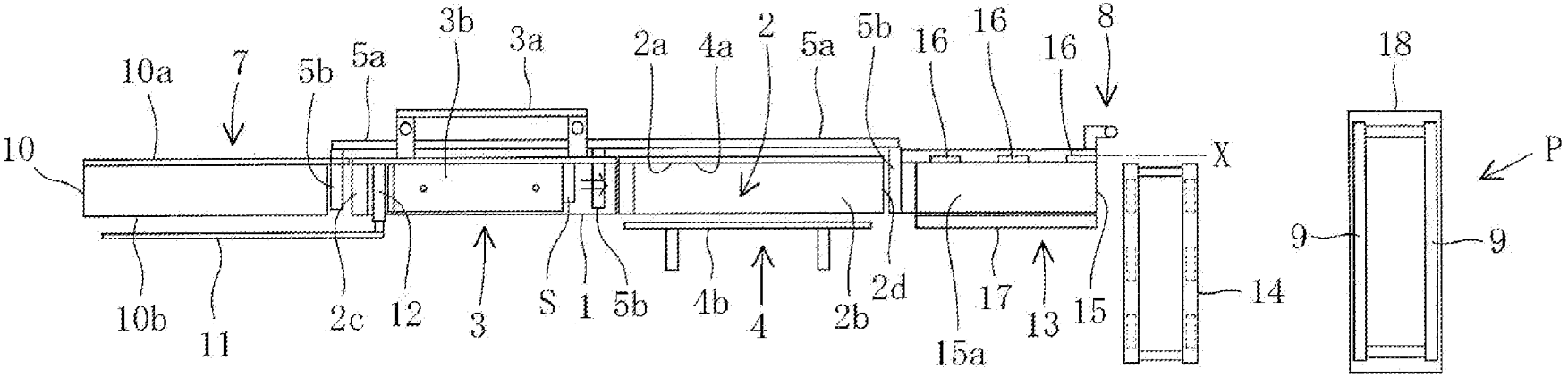
FIG. 2A shows a plan view of the schematic configuration of the book block feed device according to the example of the present disclosure.
Figure 2B:
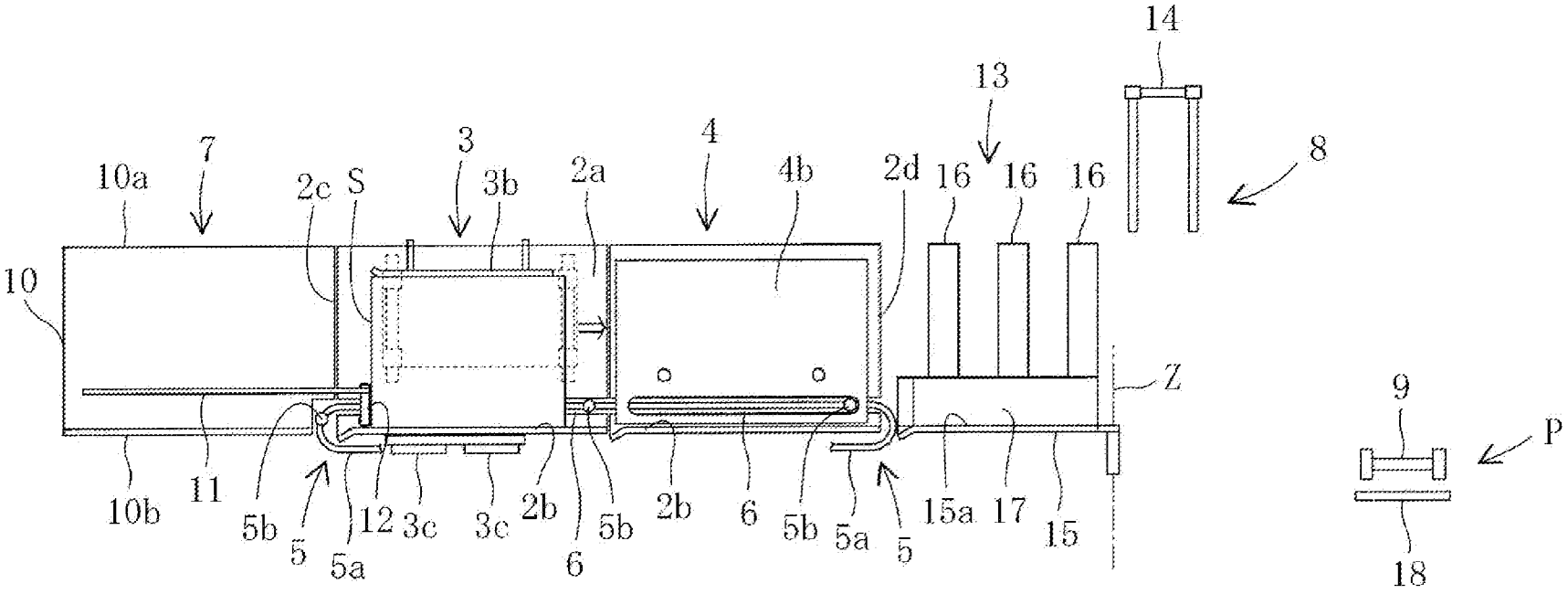
FIG. 2B shows a front view of the schematic configuration of the book block feed device according to the example of the present disclosure.
Figure 3A:
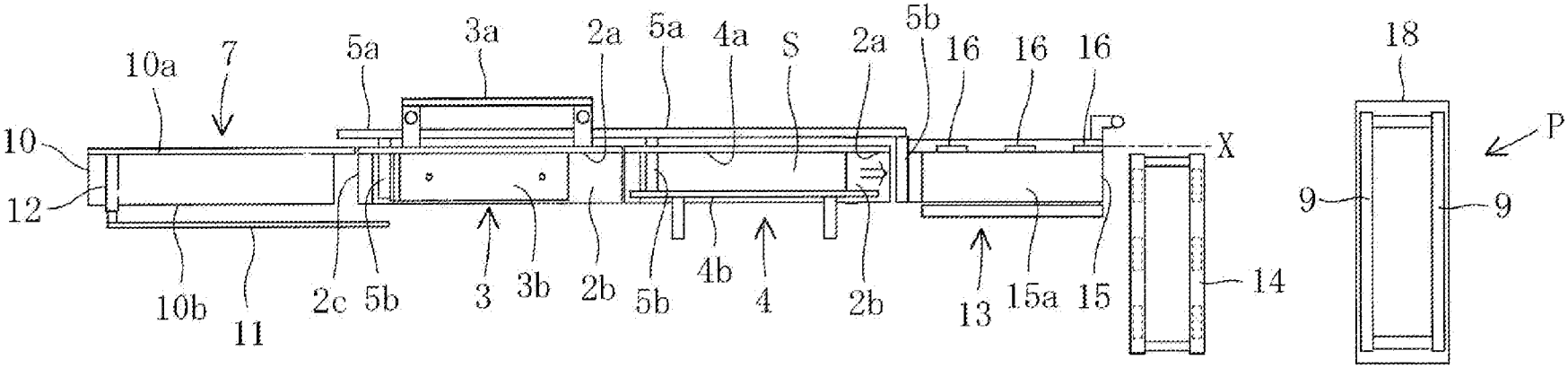
FIG. 3A shows a plan view of the schematic configuration of the book block feed device according to the example of the present disclosure.
Figure 3B:
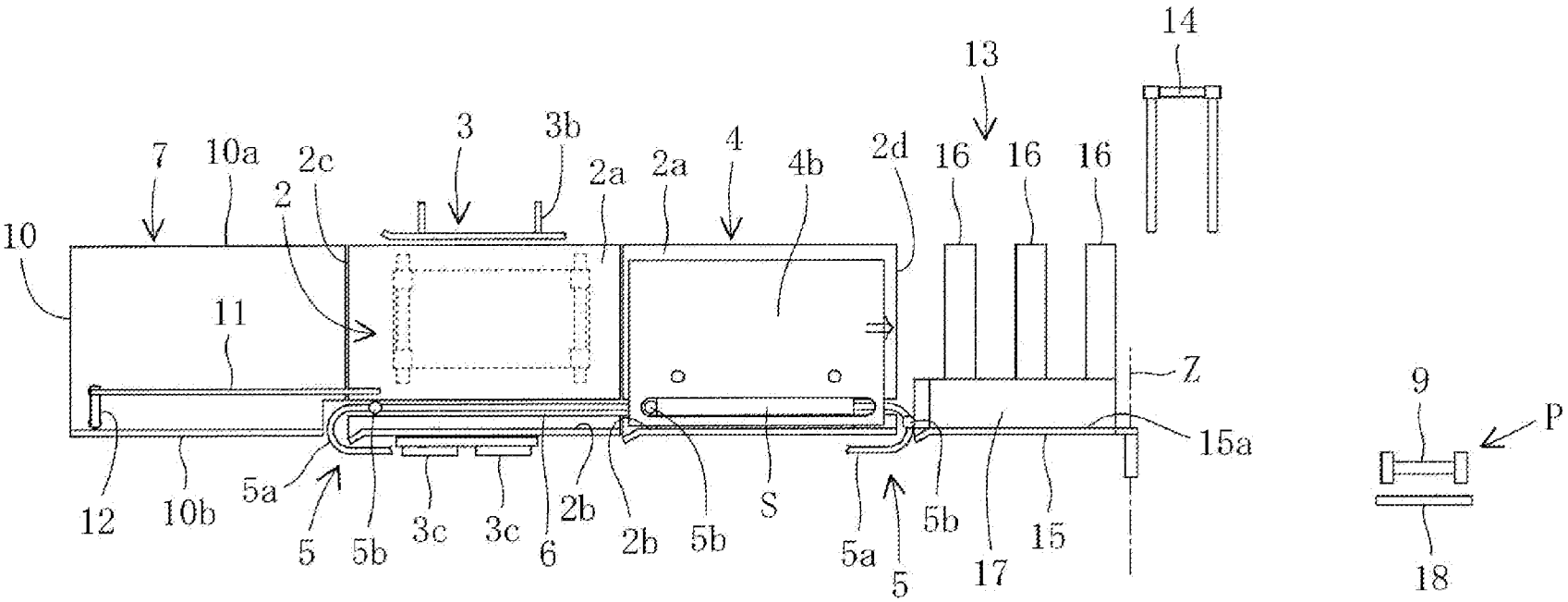
FIG. 3B shows a front view of the schematic configuration of the book block feed device according to the example of the present disclosure.
Figure 4A:
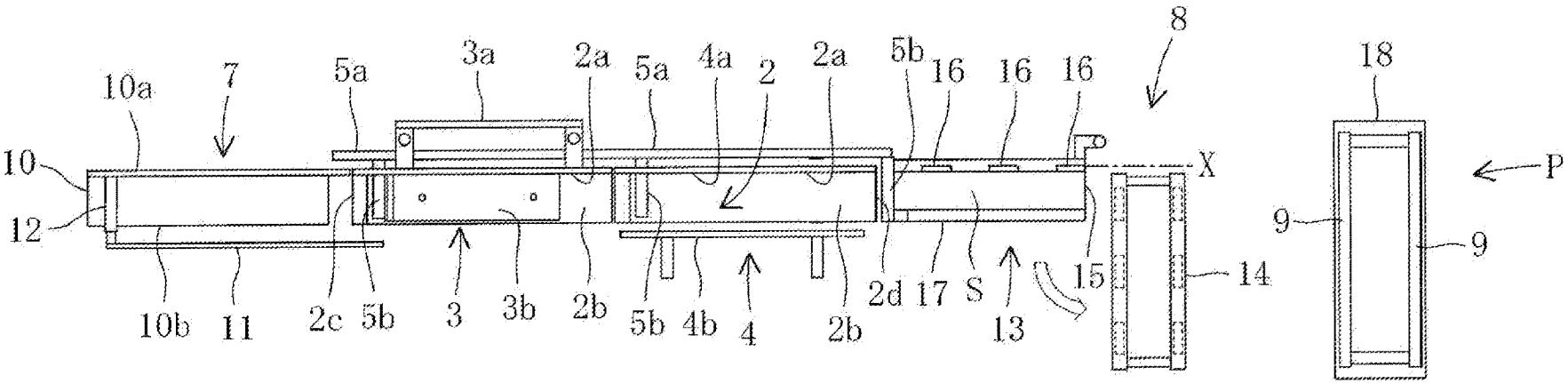
FIG. 4A shows a plan view of the schematic configuration of the book block feed device according to the example of the present disclosure.
Figure 4B:
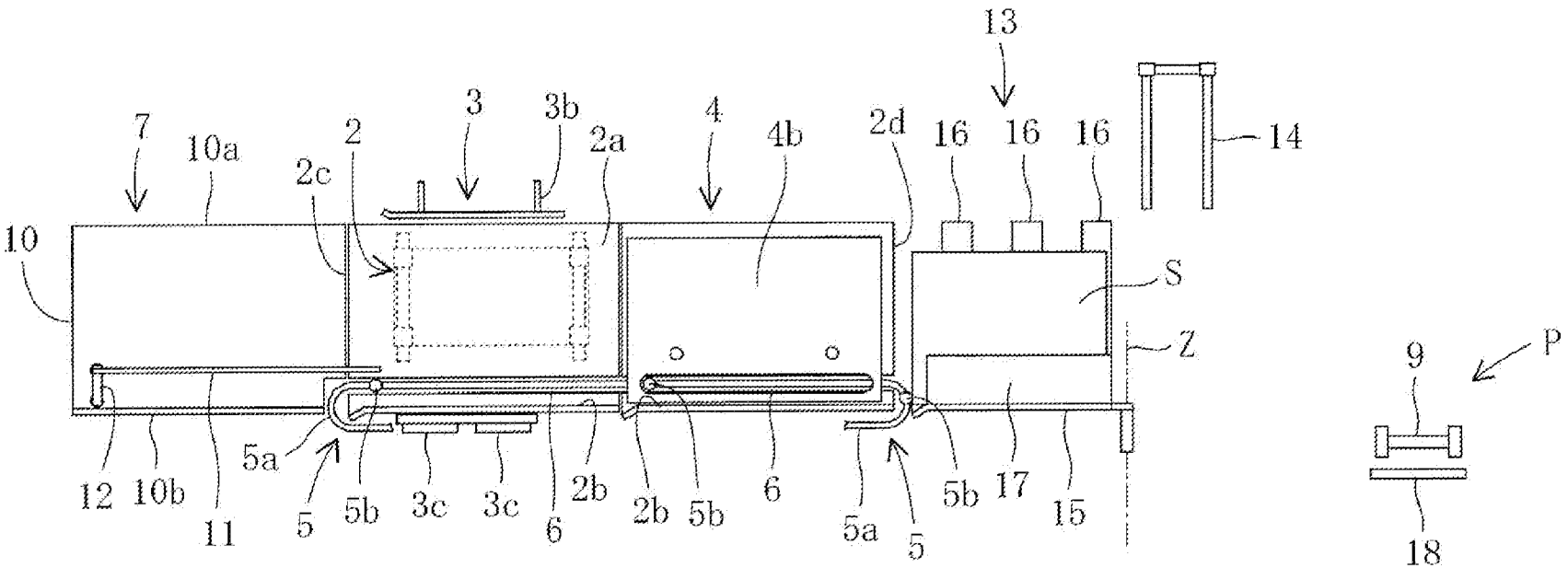
FIG. 4B shows a front view of the schematic configuration of the book block feed device according to the example of the present disclosure.
Figure 5A:
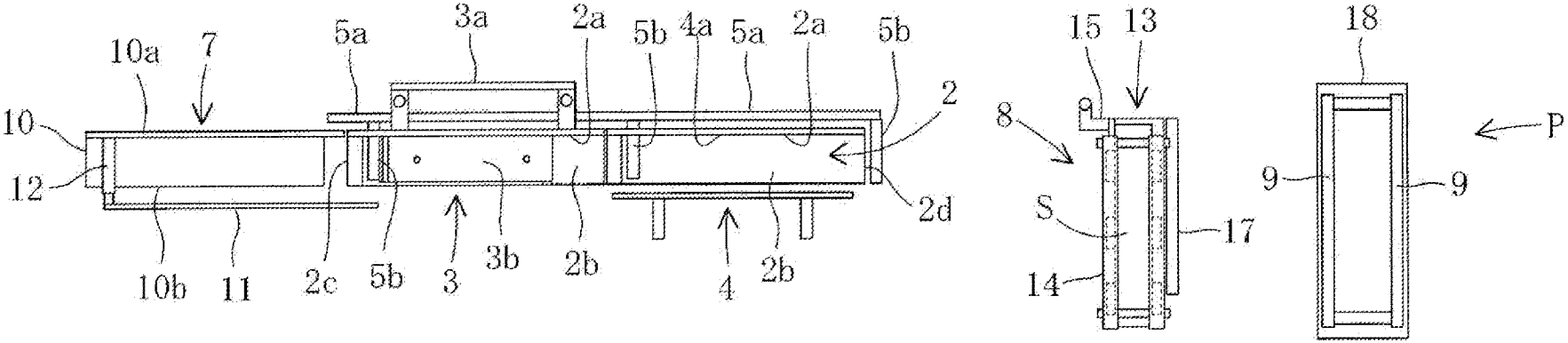
FIG. 5A shows a plan view of the schematic configuration of the book block feed device according to the example of the present disclosure.
Figure 5B:
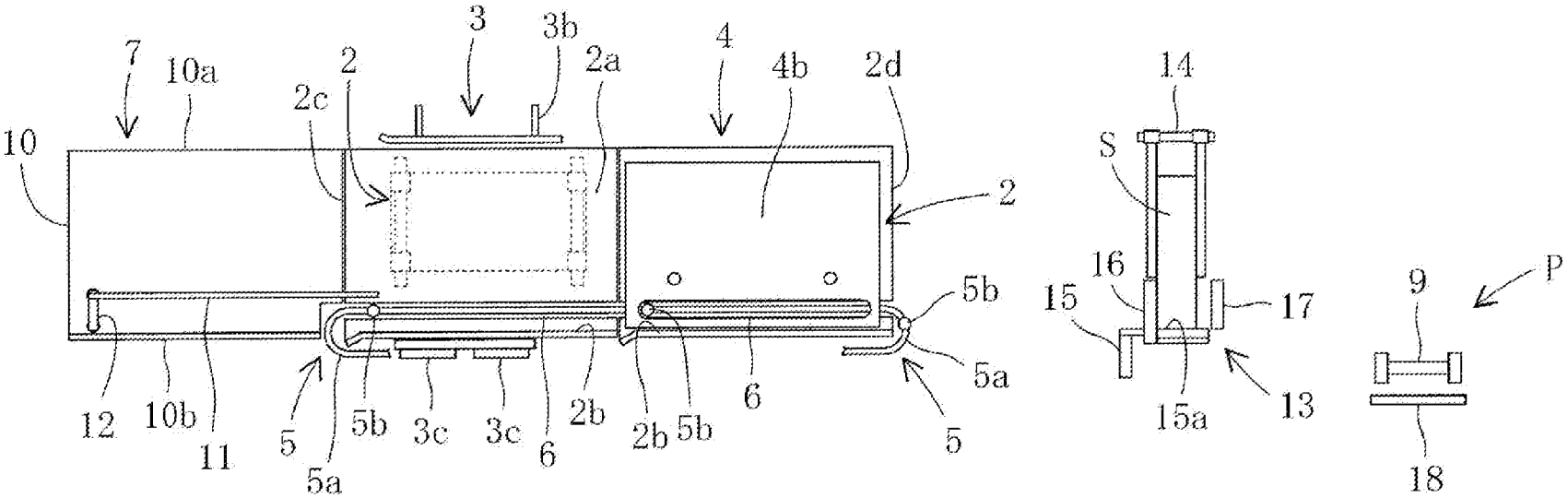
FIG. 5B shows a front view of the schematic configuration of the book block feed device according to the example of the present disclosure.
Figure 6B:
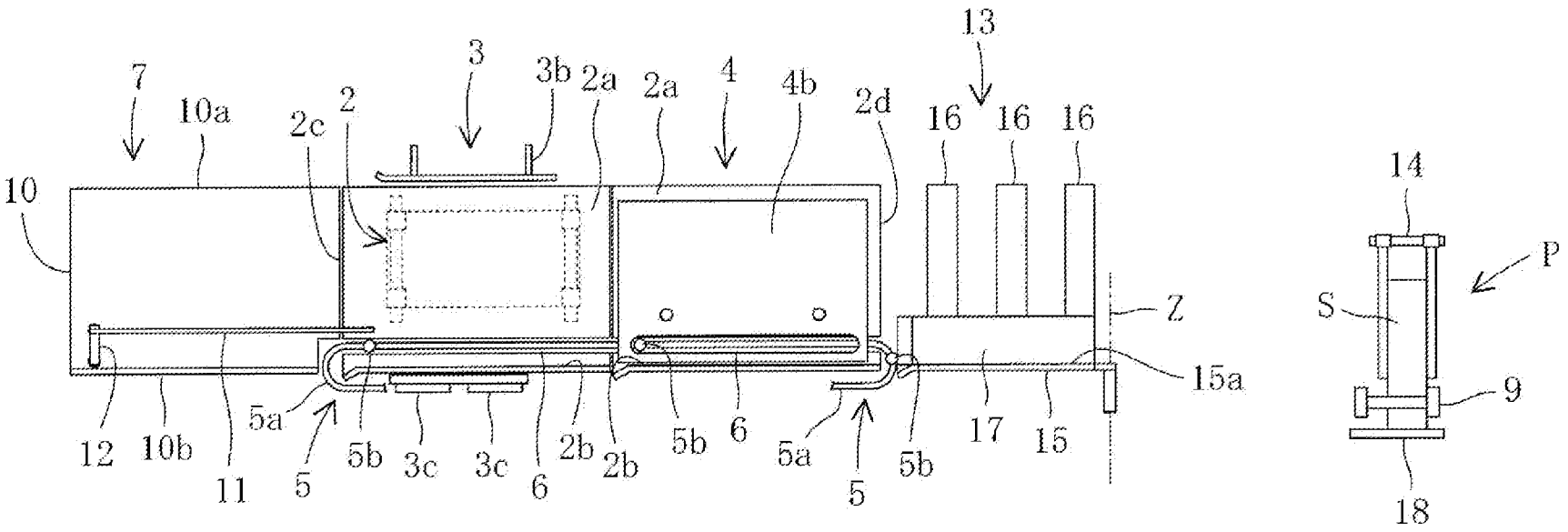
FIG. 6B shows a front view of the schematic configuration of the book block feed device according to the example of the present disclosure.

FIG. 1A shows a plan view of a schematic configuration of a book block feed device according to an example of the present disclosure. FIG. 1B shows a front view of a schematic configuration of a book block feed device according to an example of the present disclosure. Furthermore, FIG. 2A, FIG. 3A, FIG. 4A, FIG. 5A, and FIG. 6A show a plan view of the schematic configuration of the book block feed device according to the example of the present disclosure. FIG. 2B, FIG. 3B, FIG. 4B, FIG. 5B, and FIG. 6B show a front view of the schematic configuration of the book block feed device according to the example of the present disclosure.

In FIG. 1A to FIG. 6A and FIG. 1B to FIG. 6B, the book block feed device of the present disclosure comprises a frame 1 including a conveying path 2 of a book block S.

The conveying path 2 comprises a first conveying surface 2*a* inclined to support one surface of the book block S, and a second conveying surface 2*b* extending from a lower edge of the first conveying surface 2*a* at right angles to the first conveying surface 2*a*, and inclined to support one side surface of the book block S.

Note that each of FIG. 1A, FIG. 2A, FIG. 3A, FIG. 4A, FIG. 5A and FIG. 6A is drawn as a plan view of the book block feed device seen along the inclined first conveying surface 2*a* of the conveying path 2, and each of FIG. 1B, FIG. 2B, FIG. 3B, FIG. 4B, FIG. 5B and FIG. 6B is drawn as a front view of the book block feed device seen in a direction vertical to the first conveying surface 2*a*.

The book block feed device of the present disclosure comprises an alignment unit 3 and a press unit 4 that are provided in the frame 1 and adjacently arranged in order along the conveying path 2 from an inlet 2*c* to an outlet 2*d* of the conveying path 2.

The conveying path 2 comprises a part in a region of the alignment unit 3 and a part in a region of the press unit 4, the parts being independent of each other.

The alignment unit 3 includes a vibrator 3*a* coupled to the first conveying surface 2*a* of the conveying path 2, and a butt alignment guide 3*b* that butts and aligns the book block S in a direction at right angles to a conveying direction.

Note that the butt alignment guide 3*b* is provided as required. A separate butt alignment guide that butts and aligns the book block S in the conveying direction may be provided together with the butt alignment guide 3*b* or in place of the butt alignment guide 3*b*.

Furthermore, at least one air outlet (not shown) is opened in the second conveying surface 2*b* of the conveying path 2 in the alignment unit 3, and the alignment unit 3 further includes a blower 3*c* connected to the air outlet.

The press unit 4 includes a press surface 4*a* that forms a part of the first conveying surface 2*a* of the conveying path 2, a press plate 4*b* that is disposed to face the press surface 4*a* and movable in a direction close to and away from the press surface 4*a*, and a press plate drive mechanism (not shown) that moves the press plate 4*b* in a direction vertical to the press surface 4*a* between a standby position away from the book block S disposed on the press surface 4*a* and a pressing position to press the book block S toward the press surface 4*a*.

The book block feed device comprises a conveying mechanism 5 that intermittently conveys the book block S along the conveying path 2.

The conveying mechanism 5 includes a pair of rotary shafts (not shown) extending in a width direction of the second conveying surface 2*b* at opposite ends of the conveying path 2, a sprocket (not shown) attached to each rotary shaft, an endless chain 5*a* disposed across a pair of sprockets, conveying pins 5*b* attached to the endless chain 5*a* and arranged at equal intervals in a length direction of the endless chain 5*a*, and a drive mechanism (not shown) that drives one of the pair of rotary shafts.

In the first conveying surface 2*a*, a slit 6 extending in the conveying direction is formed, and each conveying pin 5*b* of the conveying mechanism 5 extends through the slit 6 to protrude onto the first conveying surface 2*a*.

Then, the endless chain 5*a* is intermittently rotated and driven by a distance corresponding to the interval between the adjacent conveying pins 5*b*, and the conveying pins 5*b* intermittently pushes the book block S. Consequently, the book block S is intermittently conveyed for each unit between the alignment unit 3 and the press unit 4.

The book block feed device further comprises a paper feed unit 7 provided in the frame 1 and disposed in the inlet 2*c* of the conveying path 2, to receive feed of the book block S and to send the received book block S to the alignment unit 3 in accordance with a timing of the intermittent conveyance, and a transfer mechanism 8 provided in the frame 1 and disposed in the outlet 2*d* of the conveying path 2, to feed the book block S pressed by the press unit 4 to a clamper 9 for a bookbinding machine.

The paper feed unit 7 includes a support plate 10 attached to the frame and having an L-shaped cross section in correspondence with the conveying path.

The support plate 10 is disposed so as to be adjacent to the conveying path 2, and so that an inner surface of a vertical part 10*a* of the support plate 10 matches the first conveying surface 2*a* of the conveying path 2, and an inner surface of a horizontal part 10*b* of the support plate 10 matches the second conveying surface 2*b* of the conveying path 2.

The paper feed unit 7 also includes a slide guide 11 extending in parallel with the vertical part 10*a* in the length direction of the support plate 10 obliquely above the horizontal part 10*b* of the support plate 10, a conveying pin 12 slidably attached to the slide guide 11 and extending from the slide guide 11 toward the vertical part in the width direction of the horizontal part 10*b* of the support plate 10, and a pin drive mechanism (not shown) that reciprocates and slides the conveying pin 12 between a first position where the conveying pin 12 is disposed in the inlet 2*c* of the conveying path 2 and a second position where the conveying pin 12 is disposed away from the first position by a distance corresponding to a length of the book block (the length in the conveying direction).

Then, when the conveying pin 12 is present at the second position, the book block S is fed from outside onto the support plate 10 (see FIG. 1), and then the conveying pin 12 moves to the first position while pushing the book block S in accordance with the timing of the intermittent conveyance of the conveying mechanism 5. Consequently, the book block S is fed to the alignment unit 3 (see FIG. 2).

The transfer mechanism 8 includes a receiving unit 13 attached to the frame 1, to receive the book block S discharged from the press unit 4 and to support the book block in a vertically standing state, a hand unit 14 that is to hold the book block S supported by the receiving unit 13, and a hand moving mechanism (not shown) attached to the frame 1, to move the hand unit 14 between the receiving unit 13 and the clamper 9 for the bookbinding machine.

The receiving unit 13 includes a carriage 15 having a flat upper surface 15*a* that supports the aforementioned one side surface of the book block S, a fixing plate 16 attached to the carriage 15 and extending vertically to the upper surface 15*a*, to support the one surface of the book block S, a movable plate 17 that is disposed to face the fixing plate 16 and movable in a direction close to and away from the fixing plate 16, and a plate drive mechanism (not shown) attached to the carriage 15, to move the movable plate 17 in a direction vertical to the fixing plate 16 between a holding position to hold the book block S between the movable plate and the fixing plate 16 and a hold releasing position that is away from the book block S on the fixing plate 16.

The receiving unit 13 further includes a carriage drive mechanism (not shown) attached to the frame 1, to turn the carriage 15 about a vertical axis Z between an aligned position where the upper surface 15*a* and the fixing plate 16 are arranged on a straight line with the conveying path 2 and a turned position rotated by 90° from the aligned position, and to rotate the carriage 15 about an axis X parallel to a line of intersection of the upper surface 15*a* with the fixing plate 16 between a standing position where the upper surface 15*a* is disposed horizontally and the fixing plate 16 is disposed vertically and a tilt position where the upper surface 15*a* matches the second conveying surface 2*b* and the fixing plate 16 matches the first conveying surface 2*a* at the aligned position.

In this example, when the carriage 15 takes the turned position, the carriage is disposed right next to the clamper 9 stopped at a book block feed position P of the bookbinding machine and in parallel with the clamper 9.

Although not shown in the drawing, the hand moving mechanism includes a slide guide extending in a direction orthogonal to the clamper 9 stopped at the book block feed position P above the carriage 15 in the turned position, a slider slidably attached to the slide guide, a slider drive mechanism that slides and moves the slider, and a lifting mechanism attached to the slider, to liftably support the hand unit 14.

Furthermore, a horizontal plate 18 is disposed below the clamper 9 stopped at the book block feed position P of the bookbinding machine, at the position P, to support a lower surface of the book block S fed to the clamper 9.

Next, an operation of the book block feed device of the present disclosure will be described.

As shown in FIG. 1, when the conveying pin 12 of the paper feed unit 7 is present at the second position, the book block S is fed from outside onto the support plate 10, and then, as shown in FIG. 2, the conveying pin 12 moves to the first position while pushing the book block S in accordance with the intermittent conveyance of the conveying mechanism 5. Consequently, the book block S is fed to the alignment unit 3.

In the alignment unit 3, in a state where vibration of the first conveying surface 2*a* and the butt alignment guide 3*b* by the vibrator 3*a* is continued, blowout of handling air through the air outlet is started in accordance with a timing when the book block S enters the alignment unit 3. The blowout of handling air continues also after end of a conveying operation of the book block S by the conveying mechanism 5, and stops prior to start of the next conveying operation of the conveying mechanism 5 (see FIG. 2). Consequently, the book block S is aligned.

Afterward, the conveyance by the conveying mechanism 5 is started, and as shown in FIG. 3, the aligned book block S is pushed toward the press unit 4 on the conveying path 2 by the conveying pin 5*b* of the conveying mechanism 5.

When the book block S is conveyed to the press unit 4 by the conveying mechanism 5, the press plate 4*b* at the standby position takes the pressing position, and returns to the standby position again. Consequently, air in the book block S is removed.

After end of processing by the press unit 4, the carriage 15 of the receiving unit 13 at the aligned position takes the tilt position, and the movable plate 17 simultaneously takes the hold releasing position.

Then, as shown in FIG. 4, the pressed book block S is pressed by the conveying pin 5*b* of the conveying mechanism 5, and inserted along the upper surface 15*a* of the receiving unit 13 into a space between the fixing plate 16 and the movable plate 17. Afterward, the movable plate 17 takes the holding position, and the book block S is held in a vertically standing state.

Next, as shown in FIG. 5, the carriage 15 turns from the aligned position to the turned position while rotating from the tilt position to the standing position. Then, when the carriage 15 is disposed at the standing position in the tilt position, the hand unit 14 lowers to hold the book block S.

Afterward, the movable plate 17 of the receiving unit 13 takes the hold releasing position, and the hand unit 14 holding the book block S rises, and then moves to a position right above the clamper 9 stopped at the book block feed position P.

Furthermore, as shown in FIG. 6, the hand unit 14 lowers until the lower surface of the book block S abuts on the horizontal plate 18, and inserts the book block S to the opened clamper 9.

Then, the clamper 9 closes to hold the book block S, and then the hand unit 14 releases the hold of the book block S and rises, thereby completing the feed of the book block S to the clamper 9.

Thus, according to the present disclosure, in the alignment unit 3, the book block S is aligned by the vibration and butt alignment, while blowing the handling air to the book block S, and hence processing of aligning the book block S can be performed at high speed.

Furthermore, according to the present disclosure, the book block S aligned by the alignment unit 3 is pressed by the press unit 4 to remove air from the book block S, and then the book block S is fed to the clamper 9 (the bookbinding machine) by the transfer mechanism 8.

Thus, the air is removed, and hence an aligned state of the book block S does not easily collapse. Therefore, when the book block S is transferred to the clamper 9 (the bookbinding machine) by the transfer mechanism 8, the alignment of the book block S can be reliably prevented from being disordered.

Consequently, the book block S can be fed always in the aligned state even to the clamper 9 (the bookbinding machine) that does not include a mechanism of correcting the disorder of the alignment of the book block S.

Furthermore, according to the present disclosure, the paper feed unit 7, the alignment unit 3 and the press unit 4 are adjacently arranged on a straight line, and the book block S is intermittently conveyed for each unit between the alignment unit 3 and the press unit 4. The book block S is fed from the paper feed unit 7 in accordance with the timing of the intermittent conveyance, and the processing operation to the book block S by each of the alignment unit 3 and the press unit 4 is performed. Consequently, the alignment of the book block S and the subsequent air removal can be performed at high speed.

Additionally, the book block S having air removed in a tilt state by the press unit 4 is received still with such a posture by the receiving unit 13 of the transfer mechanism 8, disposed in parallel with the clamper 9 for the bookbinding machine while raising the book block to change a direction of the bundle, and conveyed to the clamper 9 by the hand unit 14. Consequently, the book block S can be transferred between the press unit 4 and the clamper 9 without disordering the alignment of the book block S and at high speed.

As above, the preferable example of the present disclosure has been described, but the configuration of the present invention is not limited to the above example. Needless to say, a person skilled in the art can come up with various modifications within the scope of the configuration defined in the appended claims.

What is claimed is:

1. A book block feed device that feeds a book block to a bookbinding machine, comprising:

an alignment unit and a press unit that are adjacently arranged in order along a conveying path of the book block from an inlet to an outlet of the conveying path; and a transfer mechanism disposed in the outlet of the conveying path to feed the book block pressed by the press unit to the bookbinding machine, wherein the alignment unit includes at least one vibrator that vibrates the book block and a blower connected to an air outlet opened in the conveying path, wherein the press unit includes:

a press surface that forms a part of a conveying surface of the conveying path; and a press plate that sandwiches and presses the book block between the press plate and the press surface, wherein the transfer mechanism includes:

a receiving unit that receives the book block discharged from the press unit and supports the book block in a vertically standing state;

a hand unit that is to hold the book block supported by the receiving unit; and a hand moving mechanism attached to the frame to move the hand unit between the receiving unit and the bookbinding machine, and wherein the receiving unit includes:

a carriage having a flat upper surface that supports the one side surface of the book block;

a fixing plate attached to the carriage to support the one surface of the book block:

a movable plate that is disposed to face the fixing plate and movable in a direction close to and away from the fixing plate;

a plate drive mechanism to move the movable plate between a holding position to hold the book block between the movable plate and the fixing plate and a hold releasing position that is away from the book block on the fixing plate; and a carriage drive mechanism to turn the carriage between an aligned position where the upper surface and the fixing plate are arranged on a straight line with the conveying path and a turned position rotated from the aligned position in a state where the movable plate is arranged in the holding position.

2. The book block feed device according to claim 1, further comprising:

a frame including the conveying path, wherein the conveying path includes:

a first conveying surface to support one surface of the book block; and a second conveying surface extending from a lower edge of the first conveying surface, and to support one side surface of the book block, wherein the alignment unit and the press unit are provided in the frame, wherein the conveying path includes a part in a region of the alignment unit and a part in a region of the press unit independent from the part in the region of the alignment unit, wherein the at least one vibrator is coupled to the first conveying surface and/or the second conveying surface of the conveying path, wherein the press surface forms a part of the first conveying surface of the conveying path, wherein the press plate is disposed to face the press surface and is movable in a direction close to and away from the press surface, wherein the press unit includes a press plate drive mechanism that moves the press plate in a direction vertical to the press surface between a standby position away from the book block disposed on the press surface and a pressing position to press the book block toward the press surface, wherein the book block feed device further comprises:

a conveying mechanism that conveys the book block along the conveying path; and a paper feed unit provided in the frame and disposed in the inlet of the conveying path, to receive feed of the book block and to send the received book block to the alignment unit, and wherein the book block sent from the paper feed unit is conveyed between the alignment unit and the press unit by the conveying mechanism and is subjected to a processing operation to the book block by each of the alignment unit and the press unit.

3. The book block feed device according to claim 1, further comprising a conveying mechanism that conveys the book block along the conveying path, wherein, when the book block is conveyed to the press unit by the conveying mechanism, the press plate at a standby position away from the book block disposed on the press surface takes a pressing position to press the book block toward the press surface and returns to the standby position again in order to remove air in the book block.

4. A book block feed device that feeds a book block to a bookbinding machine, comprising:

an alignment unit and a press unit that are adjacently arranged in order along a conveying path of the book block from an inlet to an outlet of the conveying path, the alignment unit including at least one vibrator that vibrates the book block, the press unit including a press surface that forms a part of a conveying surface of the conveying path, and a press plate that sandwiches and presses the book block between the press plate and the press surface; and a frame including the conveying path, the conveying path including a first conveying surface to support one surface of the book block, and a second conveying surface extending from a lower edge of the first conveying surface, and to support one side surface of the book block, wherein the alignment unit and the press unit are provided in the frame, wherein the conveying path includes a part in a region of the alignment unit and a part in a region of the press unit, the parts being independent of each other, wherein the at least one vibrator is coupled to the first conveying surface and/or the second conveying surface of the conveying path, wherein the press surface forms a part of the first conveying surface of the conveying path, and wherein the press plate is disposed to face the press surface, and movable in a direction close to and away from the press surface, the press unit including a press plate drive mechanism that moves the press plate in a direction vertical to the press surface between a standby position away from the book block disposed on the press surface and a pressing position to press the book block toward the press surface, wherein the book block feed device further comprises a conveying mechanism that conveys the book block along the conveying path;

a paper feed unit provided in the frame and disposed in the inlet of the conveying path, to receive feed of the book block and to send the received book block to the alignment unit; and a transfer mechanism provided in the frame and disposed in the outlet of the conveying path, to feed the book block pressed by the press unit to the bookbinding machine, wherein the book block sent from the paper feed unit is conveyed between the alignment unit and the press unit by the conveying mechanism, and subjected to a processing operation to the book block by each of the alignment unit and the press unit, and wherein at least one air outlet is opened in the second conveying surface of the conveying path in the alignment unit, and the alignment unit further includes a blower connected to the at least one air outlet.

5. The book block feed device according to claim 4, wherein the transfer mechanism includes:

a receiving unit attached to the frame, to receive the book block discharged from the press unit and to support the book block in a vertically standing state, a hand unit that is to hold the book block supported by the receiving unit, and a hand moving mechanism attached to the frame, to move the hand unit between the receiving unit and the bookbinding machine.

6. The book block feed device according to claim 5, wherein the paper feed unit, the alignment unit and the press unit are arranged on a straight line, and the receiving unit includes:

a carriage having a flat upper surface that supports the one side surface of the book block, a fixing plate attached to the carriage and extending vertically to the upper surface, to support the one surface of the book block, a movable plate that is disposed to face the fixing plate and movable in a direction close to and away from the fixing plate, a plate drive mechanism attached to the carriage, to move the movable plate in a direction vertical to the fixing plate between a holding position to hold the book block between the movable plate and the fixing plate and a hold releasing position that is away from the book block on the fixing plate, and a carriage drive mechanism attached to the frame, to turn the carriage about a vertical axis between an aligned position where the upper surface and the fixing plate are arranged on a straight line with the conveying path and a turned position rotated by 90° from the aligned position, and to rotate the carriage about an axis parallel to a line of intersection of the upper surface with the fixing plate between a standing position where the upper surface is disposed horizontally and the fixing plate is disposed vertically and a tilt position where the upper surface matches the second conveying surface and the fixing plate matches the first conveying surface at the aligned position.

* * * * *